United States Patent [19]

Romagnoli

[11] 4,072,074

[45] Feb. 7, 1978

[54] DEVICE FOR FORMING ORDERLY ARRANGED GROUPS OF PACKAGES FROM A CONTINUOUS WEB OF PACKAGES

[76] Inventor: Andrea Romagnoli, Via Madonna dei Boschi 18, S. Lazzaro Di Savena (Province of Bologna), Italy

[21] Appl. No.: 768,508

[22] Filed: Feb. 14, 1977

[30] Foreign Application Priority Data

Feb. 13, 1976 Italy ..... 3335/76

[51] Int. Cl.[2] ..... B26D 7/06

[52] U.S. Cl. ..... 83/85; 83/90; 83/96; 83/97

[58] Field of Search ..... 83/85, 86, 90, 94, 96, 83/138, 140, 97

[56] References Cited

U.S. PATENT DOCUMENTS

| | | | |
|---|---|---|---|
| 966,160 | 8/1910 | Brady | 83/86 |
| 1,450,945 | 4/1923 | Furber | 83/86 X |
| 2,604,167 | 7/1952 | Oliver | 83/86 |
| 3,491,633 | 1/1970 | White | 83/85 X |
| 3,735,654 | 5/1973 | Jurasek | 83/140 X |

*Primary Examiner*—Willie G. Abercrombie
*Attorney, Agent, or Firm*—Guido Modiano; Albert Josif

[57] ABSTRACT

Device for forming orderly arranged groups of packages from a continuous web of packages, comprising a first stem slidably guided vertically and driven between a lowered position underlying the web and a raised position overlying the web, a support secured to the top of the stem, a punching member attached to the support and having a sidewall. The sidewall surrounds a cavity and includes a border defining externally a cutting edge. A die support is provided such as to have a lower side substantially adhering to the upper side of the web and having an opening aligned with and complementary to the punching member, such as to permit the insertion thereof through the opening and the punching out of one package from the web during the raising movement of the punching member from the lowered position to the raised position. A second stem is slidably guided parallel to the first stem and is provided at the top with a plate receivable in the cavity. The stem is driven between a position wherein the plate underlies the web and a position wherein the plate overlies the web after the package punching has been completed. A stacking magazine is provided for the raised packages. The stacking magazine is located above the die and is inclusive of a retaining means such that for each raised package there occurs a raising of the packages previously introduced in the magazine and the resting of the package last introduced on the retaining means.

4 Claims, 2 Drawing Figures

DEVICE FOR FORMING ORDERLY ARRANGED GROUPS OF PACKAGES FROM A CONTINUOUS WEB OF PACKAGES

BACKGROUND OF THE INVENTION

This invention relates to a device for forming orderly arranged groups of packages from a continuous web of packages.

The device is particularly suitable for use in punching out and stacking together thermoformed plates of a plastic material, also known as "blisters".

As is known, "blisters" are obtained by first forming cavities in a thermoplastic film, followed by the introduction of the product (tablets, pills, and the like) into such cavities, and lastly by applying a metal film to close the cavities by heat sealing. A continuous web is thus obtained, wherefrom individual packages are punched out, assembled together, and subsequently introduced in their containers. For the punching of the packages, and their collecting together, separate apparata are presently utilized which require the aid of auxiliary conveying and coordinating equipment, thereby involving a great expenditure of technical and economic efforts.

SUMMARY OF THE INVENTION

It is a primary object of this invention to provide a device capable of effecting the package punching and collecting operations simultaneously, such as to eliminate the need for all those accessories which are provided in the conventional machines between the two operations.

This object is achieved by a device, according to the invention, for forming orderly arranged groups of packages from a continuous web of packages, characterized in that it comprises a first stem slidably guided vertically and driven between a lowered position underlying the web and a raised position overlying the web, a support secured to the top of said stem, a punching member attached to said support and having a sidewall, said sidewall surrounding a cavity and including a border defining externally a cutting edge, a die supported such as to have a lower side substantially adhering to the upper side of the web and having an opening aligned with and complementary to the punching member, such as to permit the insertion thereof through the opening and the punching out of one package from the web during the raising movement of the punching member from said lowered position to said raised position, a second stem slidably guided parallel to the first stem and provided at the top with a plate receivable in said cavity, said stem being driven between a position wherein said plate underlies the web and a position wherein the plate overlies the web after the package punching has been completed, a stacking magazine being provided for the raised packages, said stacking magazine being located above said die and inclusive of a retaining means such that for each raised package there occurs a raising of the packages previously introduced in the magazine and the resting of the package last introduced on said retaining means.

BRIEF DESCRIPTION OF THE DRAWINGS

Further features of the invention will become apparent from the following description of an embodiment thereof, illustrated by way of example only in the accompanying drawings, where.

DESCRIPTION OF THE PREFERRED EMBODIMENTS

Figure 1:
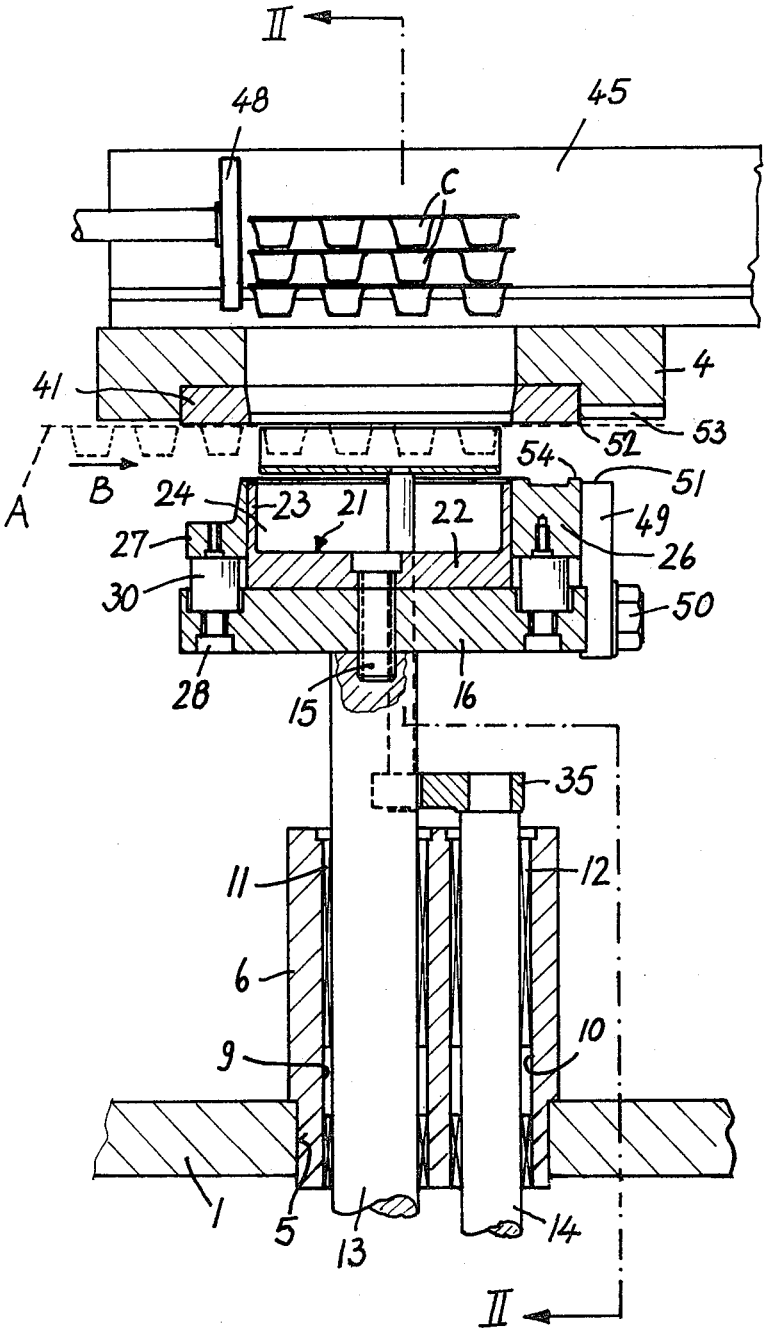
FIG. 1 is an elevational view, partly in section, of the instant device taken along the line I—I of FIG. 2.

The device being described in detail hereinafter is discussed with reference to the forming of package groups or stacks, called "blisters" and obtained from a continuous web. The web is indicated in the drawings at A and is moved on a horizontal plane in the direction of the arrow B of an intermittent motion and a pitch equal to the width of the package as measured in the direction of the arrow B, also referred to as longitudinal direction, as against the term "transversal" which means "perpendicular" to said direction.

The device comprises a frame including a base 1, wherefrom two shoulders 2, 3 extend upwardly which are connected at the top by a crossmember 4. The base 1 has a hole 5, wherein a body 6 is centered, being supported by wings 7, 8 welded thereto and to the shoulders 2, 3. Two parallel and vertical holes 9, 10 are formed in the body 6, wherethrough two stems 13, 14 are guided with the interposition of frictionless bushings 11, 12. To the top of the stem 13, there is attached by means of a bolt 15 a support or plate 16 of rectangular shape and provided, at the corners thereof, with four sleeves 17 projecting upwardly from the plate 16. Through the sleeves 17, with the interposition of frictionless bushings 18, respective pins 19 are guided which project downwardly from the crossmember 4 whereto they are rigidly mounted. The plate 16 is raised and lowered by a cam (not shown) acting on the lower end of the stem 13. Moreover, the plate 16 is prevented from rotating by the sliding engagement of the pins 19 within the sleeves 17.

To the plate 16, by means of screws 20, a punching member 21, in the shape of a rectangular chest, is secured which comprises a bottom 22 from the periphery whereof a sidewall 23 extends upwardly. The sidewall 23 encloses a cavity 24, and its upper border defines on the outside a cutting edge or knife edge 25 for the punching out of the packages, as will be more fully described hereinafter. On the sidewall 23, a collar 26 is guided which adheres to the outer side of the sidewall itself, thereby it has a rectangular shape. From the four sides of the collar 26 there project outwardly lugs 27, which are located at the midpoints of the four sides and carry eyes, wherethrough respective bolts 28 are threadably engaged. The bolts 28 have their stems slidably led through holes 29 in the plate 16, and at the areas thereof included between the lugs 27 and plate 16, the bolts carry sleeves 30 of a resilient material, which engage with their lower portions into recesses in that plate. The sleeves 30 hold the collar 26 in a raised position, whereat the upper edge 31 of the collar 26 projects beyond the cutting or knife edge 25. That position is determined by the heads of the bolts 28 abutting the lower side of the plate 16. Two holes 32, parallel to each other and to the stem 14, are formed in the plate 16 and bottom of the chest 21. Two rods 33 are guided through such holes which are rigidly attached, at their lower ends, to two projections 34 of a support 35 secured to the top of the stem 14. The projections 34 extend in a V-like configuration from the support 35, such that the rods 33 are arranged at the sides of the stem 13.

To the tops of the rods 33, there is attached a plate 36 of rectangular shape which is receivable in the cavity 24 and is provided with a central rib or wing 37 and two side wings 38. The wings 37, 38 lay parallel to the direction B. The stem 14, as well as the stem 13, is driven upward and downward by a cam, not shown, such as to enable the plate to push each single package into a magazine, where the packages are collected together into stacks of a predetermined number.

An opening 39 is formed in the crossmember 4 wherearound, at the lower side of the crossmember, a seat 40 is formed for accommodating a ring 41 constituting the die cooperating with the punching member 21 in separating the packages from the continuous web A.

The ring 41 is of rectangular configuration and has a sharp inner corner 42 enclosing an opening 43 complementary to the chest 21 which is allowed to penetrate said opening when the stem 13 is raised by the cam. The opening 43 is slightly more tapered internally than the opening 39, thereby forming a sort of discharge outlet for the package cutting. The device discussed above is further provided with a magazine intended to retain the punched packages, this magazine comprising two sidewalls 44, 45 arranged parallel to each other and affixed to the crossmember 4 along the two longitudinal edges or borders of the opening 39. The sidewalls 44, 45 are provided at their bottom sides with steps 46, 47 extending one toward the other beyond vertical planes conducted through the opposite longitudinal walls of the opening 43.

The instant device operates as follows. The web A, wherefrom orderly arranged groups of packages are to be formed, receives support at the bottom, at the opening 43, from the wings 38, laterally, and from the rib 37, centrally. On completion of each advancing step of the web, the stem 13 is activated which, from a lowered position, is raised and through a portion of its upward stroke determines a resilient locking of the web A between the edge 31 of the collar 26 and the lower side of the die 41.

Figure 2:
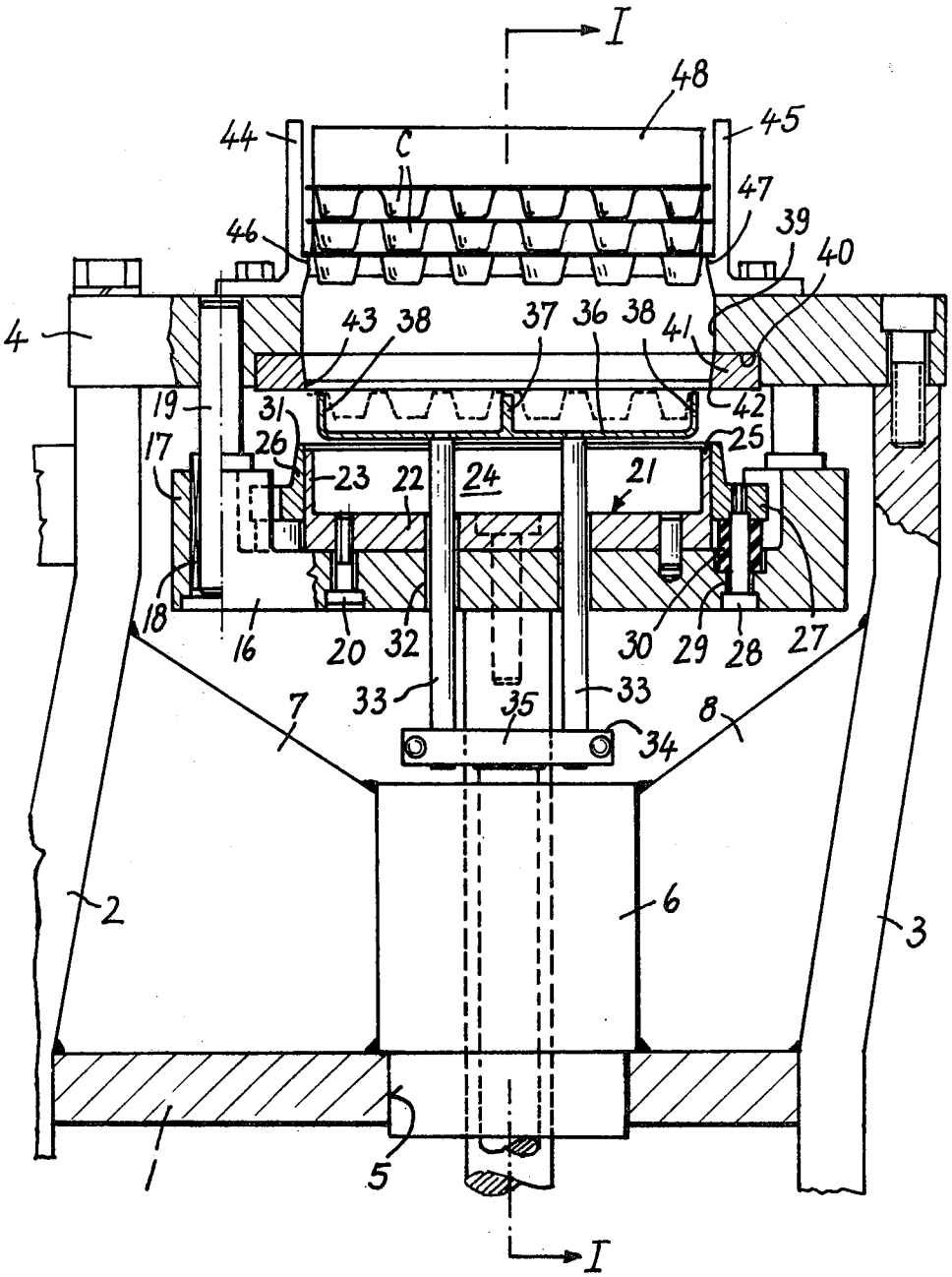
FIG. 2 is a view, also partly in section, taken along the line II—II of FIG. 1.

In order to afford an immediate stopping of the web by the collar 26, the plate is positioned at a level such as to support the web in a manner thereby the upper side of the latter is in near rubbing contact with the die lower side. As the upward stroke of the stem 13 continues, the chest 21 penetrates the opening 43 and the package C is punched out by the corners 25, 42 which by acting like a pair of scissors cut the web at the areas between the cavities or blisters. Then the plate 36 is raised and brings the package C above the level of the steps 46, 47 whereon the package rests with its two opposite longitudinal edges. Obviously, in order to clear the neck formed by the steps 46, 47, the mutual distance whereof is less than the transversal dimension of the package C, the latter is forced to flex slightly. After the package is resting on the steps 46, 47, the plate 36 and chest 21 are returned to their lowered position, as shown in FIG. 2. The web A is then advanced through another step, and a fresh package is punched out as described above.

It should be noted that, as each package is transferred into the magazine, the previously introduced packages are lifted up until a package stack of the determined number is obtained. That stack of packages is then transferred to and introduced into, through a pusher 48, e.g. a container in alignment therewith.

Of the web A, only two longitudinal offcuts are left. According to a variation of this invention, a cutter is also provided to cut such side offcuts into small chips. That cutter is indicated at 49 and is attached by means of screws 50 to the transversal edge of the plate 16 located downstream with respect to the direction B. The top of the cutter 49 defines a knife edge 51 which cooperates with the knife edge 52 defined along a transversal lower border of the ring 41. During the raising of the rod 13, the top of the cutter penetrates a notch 53 in the plate 16 to cause the offcuts to be reduced into chips.

The offcuts, during the cutting thereof, are held clamped by a ridge 54 on the collar which extends transversally in contact with the cutter 49.

According to a further variation of this invention, provision is made for using, instead of the steps 46, 47, resilient reeds projecting toward the opening 39 and adapted to flex outwardly as the packages are introduced in the magazine.

I claim:

1. A device for forming orderly arranged groups of packages from a continuous web of packages, characterized in that it comprises a first stem slidably guided vertically and driven between a lowered position underlying the web and a raised position overlying the web, a support secured to the top of said stem, a punching member attached to said support and having a sidewall, said sidewall surrounding a cavity and including a border defining externally a cutting edge, a die supported such as to have a lower side substantially adhering to the upper side of the web and having an opening aligned with and complementary to the punching member, such as to permit the insertion thereof through the opening and the punching out of one package from the web during the raising movement of the punching member from said lowered position to said raised position, a second stem slidably guided parallel to the first stem and provided at the top with a plate receivable in said cavity, said stem being driven between a position wherein said plate underlies the web and a position wherein the plate overlies the web after the package punching has been completed, a stacking magazine being provided for the raised packages, said stacking magazine being located above said die and inclusive of a retaining means such that for each raised package there occurs a raising of the packages previously introduced in the magazine and the resting of the package last introduced on said retaining means.

2. A device according to claim 1, characterized in that it comprises a collar extending around said punching member and guided by the latter, said collar being carried by said support with the interposition of resilient means and having a border which, when the punching member is in said lowered position, projects above the cutting edge thereof, and which, as the punching member is raised, abuts the lower edge of the die to clamp the web to be punched along a perimeter coincident with the perimeter to be punched out.

3. A device according to claim 2, characterized in that said magazine comprises a pair of parallel sidewalls located above said die, said sidewalls being formed with steps projecting toward each other for the resting thereon of the packages punched out.

4. A device according to claim 1, characterized in that to said support there is rigidly attached a cutter lying transversally with respect to the web direction of advance, said cutter cooperating with a sharp corner presented by the die for chipping the side offcuts of the web.

* * * * *